US007228718B2

(12) United States Patent
Kim

(10) Patent No.: US 7,228,718 B2
(45) Date of Patent: Jun. 12, 2007

(54) WOBBLING WASHING MACHINE AND METHOD OF CONTROLLING THE SAME

(75) Inventor: Hyun-Sook Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 568 days.

(21) Appl. No.: 10/310,831

(22) Filed: Dec. 6, 2002

(65) Prior Publication Data

US 2004/0010861 A1 Jan. 22, 2004

(30) Foreign Application Priority Data

Jul. 16, 2002 (KR) ..... 2002-41628

(51) Int. Cl.
*D06F 33/00* (2006.01)

(52) U.S. Cl. ..... 68/12.04; 68/12.05; 68/133

(58) Field of Classification Search ..... 68/12.04, 68/131–133, 12.02, 12.05, 12.21
See application file for complete search history.

(56) References Cited

U.S. PATENT DOCUMENTS 4,402,199 A * 9/1983 Waugh ..... 68/23.3
4,403,484 A * 9/1983 Fey et al. ..... 68/23.3
4,475,363 A * 10/1984 Thomson ..... 68/23.3
5,161,393 A * 11/1992 Payne et al. ..... 68/12.04
5,460,018 A * 10/1995 Werner et al. ..... 68/23.6
5,504,955 A * 4/1996 Mueller et al. ..... 8/158
6,255,952 B1 * 7/2001 Jang ..... 340/588
6,442,979 B1 * 9/2002 Thorn et al. ..... 68/12.16
6,983,628 B2 * 1/2006 Cho ..... 68/12.01
2004/0006831 A1 * 1/2004 Kim et al. ..... 8/159

FOREIGN PATENT DOCUMENTS

KR 10-205804 4/1999

* cited by examiner

*Primary Examiner*—Joseph L. Perrin
(74) *Attorney, Agent, or Firm*—Staas & Halsey LLP

(57) ABSTRACT

A wobbling washing machine and a method of controlling the same. The wobbling washing machine washes laundry by causing a washboard to wobble. The wobbling washing machine has a speed varying unit which varies a wobbling speed of the washboard to correspond to a load of the laundry. The wobbling washing machine varies a rotating speed of a motor according to the load of the laundry so as to decrease the wobbling speed of the washboard in response to the load of the laundry being small, and increase the wobbling speed in response to the load of the laundry being large, thus enabling the washing machine to suitably perform a washing operation according to the load of the laundry.

11 Claims, 5 Drawing Sheets

WOBBLING WASHING MACHINE AND METHOD OF CONTROLLING THE SAME

CROSS-REFERENCE TO RELATED APPLICATIONS

This application claims the benefit of Korean Patent Application No. 2002-41628 filed on Jul. 16, 2002, in the Korean Intellectual Property Office, the disclosure of which is incorporated herein by reference.

BACKGROUND OF THE INVENTION

1. Field of the Invention

The present invention relates to wobbling washing machines, and more particularly, to a wobbling washing machine and a method of controlling the same, which performs an optimal washing according to a load of laundry.

2. Description of the Related Art

Generally, a washing machine having a wobbling device washes laundry by causing a washboard installed on an inner surface of a bottom of a spin-drying tub to wobble.

In such a washing machine, various washing courses are preprogrammed according to materials of laundry. Where a user selects any one washing course corresponding to a material of the laundry to be washed among the various washing courses, the washing machine executes washing, rinsing and spin-drying operations on the basis of washing information set to correspond to the selected washing course. This washing information may include a rotating speed of a motor which causes the washboard to wobble, a level of wash water, washing and rinsing times, a number of rinsing times, and a spin-drying time.

In a conventional wobbling washing machine, where a washing course is selected, a washing time and a washing water level are set differently according to loads, such as the quantity and weight of laundry, to carry out washing and rinsing operations.

Meanwhile, a rotating speed of a motor is set differently according to washing courses, but it is set uniformly in the same washing course regardless of a laundry load. Therefore, where the laundry load is small, the rotating speed of the motor is unnecessarily high, whereas where the laundry load is large, the rotating speed of the motor is insufficient, thus preventing the washing operation from being suitably performed.

SUMMARY OF THE INVENTION

Accordingly, an aspect of the present invention is to provide a wobbling washing machine and a method of controlling the same, which varies a wobbling speed of a washboard according to a load of laundry.

Additional aspects and advantages of the invention will be set forth in part in the description which follows and, in part, will be obvious from the description, or may be learned by practice of the invention.

To achieve the above and/or other aspects of the present invention, there is provided a wobbling washing machine comprising a housing which defines an outer appearance of the washing machine, a tub to receive laundry, a washboard which wobbles to wash the laundry, and a speed varying unit which varies a wobbling speed of the washboard to correspond to a load of the laundry.

To achieve the above and/or other aspects of the present invention, there is also provided a wobbling washing machine comprising a housing which defines an outer appearance of the washing machine, a tub to receive laundry, a washboard which wobbles to wash the laundry, a motor which rotates to cause the washboard to wobble, a weight sensing unit which senses a weight of the laundry, and a speed varying unit which varies a rotating speed of the motor in response to an output signal of the weight sensing unit.

To achieve the above and/or other aspects of the present invention, there is provided a method of controlling a wobbling washing machine having a washboard which wobbles to wash laundry and a motor which rotates to cause the washboard to wobble, the method comprising sensing a weight of the laundry, and washing the laundry by causing the washboard to wobble at a wobbling speed of the washboard corresponding to the sensed weight of the laundry.

To achieve the above and/or other aspects of the present invention, there is further provided a method of controlling a wobbling washing machine having a washboard which wobbles to wash laundry and a motor which rotates to cause the washboard to wobble, the method comprising receiving load information of the laundry, and washing the laundry by causing the washboard to wobble at a wobbling speed of the washboard corresponding to the received load information of the laundry.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
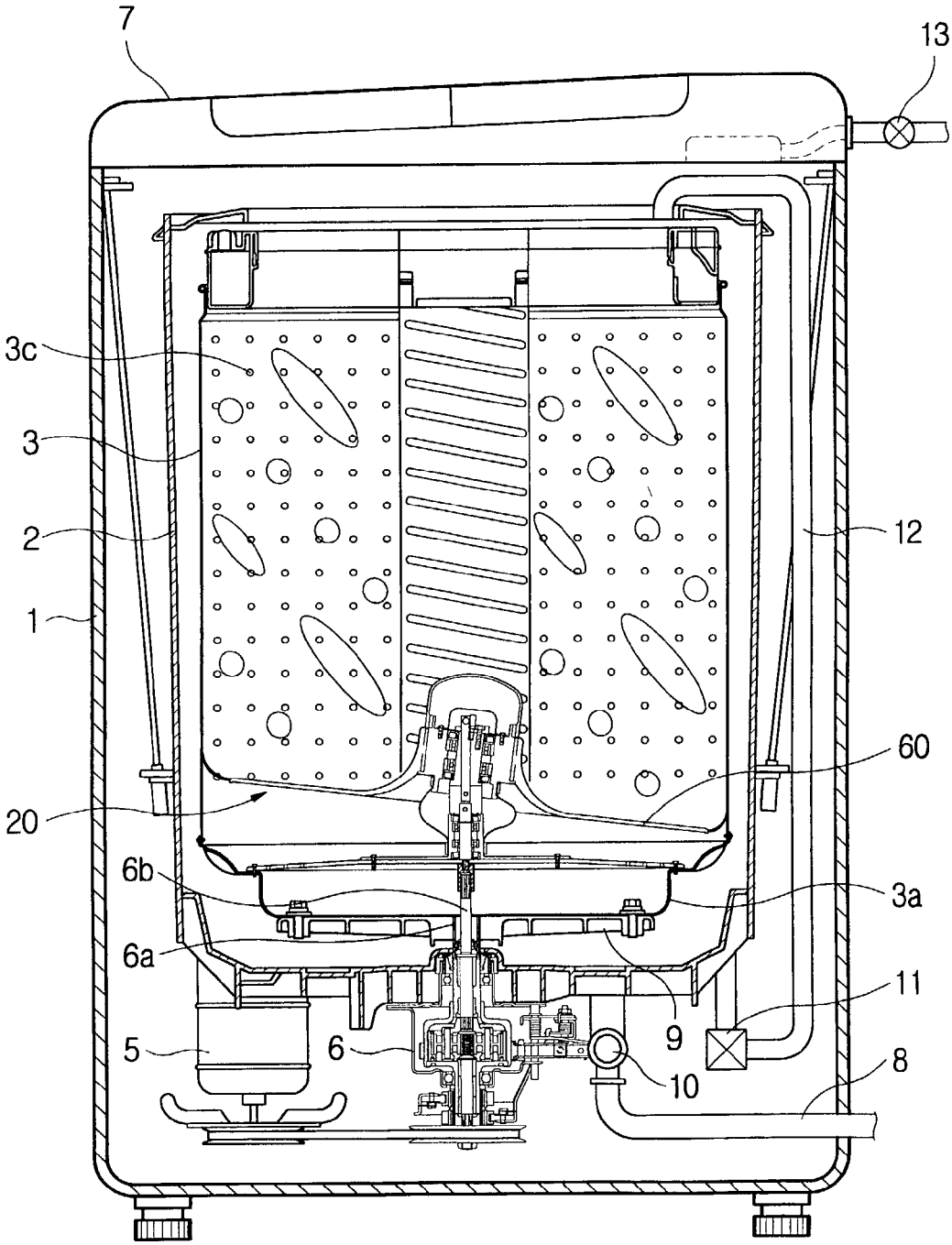
FIG. 1 is a vertical sectional view of a wobbling washing machine according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIG. 1 shows a vertical sectional view of a wobbling washing machine according to an embodiment of the present invention.

Here, a 'wobbling position' represents a position where a wobbling device 20 of the washing machine is switched to cause a washboard 60 to be inclined, thus enabling the washboard 60 to wobble upwardly and downwardly. Furthermore, a 'leveling position' represents a position where the wobbling device 20 is switched to arrange the washboard 60 horizontally, thus preventing the washboard 60 from wobbling.

As shown in FIG. 1, the washing machine having the wobbling device 20 of the present invention comprises a washing tub 2 installed within a housing 1, a spin-drying tub 3 installed within the washing tub 2 and provided with a plurality of perforation holes 3*c* formed therein, and a motor 5 and a power transmission device 6 which are installed beneath the washing tub 2. The wobbling device 20 of the present invention is arranged within the spin-drying tub 3.

A drain hose 8 is installed under the washing tub 2 and extends to the outside of the housing 1 to drain water contained in the washing tub 2, where a washing operation is completed. A pump motor 11 and a return pipe 12 which circulate wash water supplied to the washing tub 2 in an upper portion of the washing tub 2, so as to reduce the amount of water used, are installed under the washing tub 2. A water supply valve 13 is disposed in a water supply pipe connected to an external hydrant (not shown).

A spin-drying shaft support 9 is installed beneath a bottom 3*a* of the spin-drying tub 3, and a spin-drying shaft 6*a* of the power transmission device 6 is coupled with a center portion of the spin-drying shaft support 9 to rotate the spin-drying tub 3. A washing shaft 6*b* is installed within the spin-drying shaft 6*a* while penetrating through the spin-drying shaft 6*a*, with an upper portion of the washing shaft 6*b* slightly extended upwardly from the spin-drying shaft 6*a* so as to couple the washing shaft 6*b* with the wobbling device 20.

The wobbling device 20 is installed on an inner surface of the bottom 3*a* of the spin-drying tub 3. Where the wobbling device 20 is switched to the wobbling position, in which the washboard 60 is inclined, laundry therein is wobbled upwardly and downwardly to be washed. Where the wobbling device 20 is switched to the leveling position, in which the washboard 60 maintains a level condition, the wobbling device 20 rotates together with the spin-drying tub 3 to dry the laundry.

Figure 2:
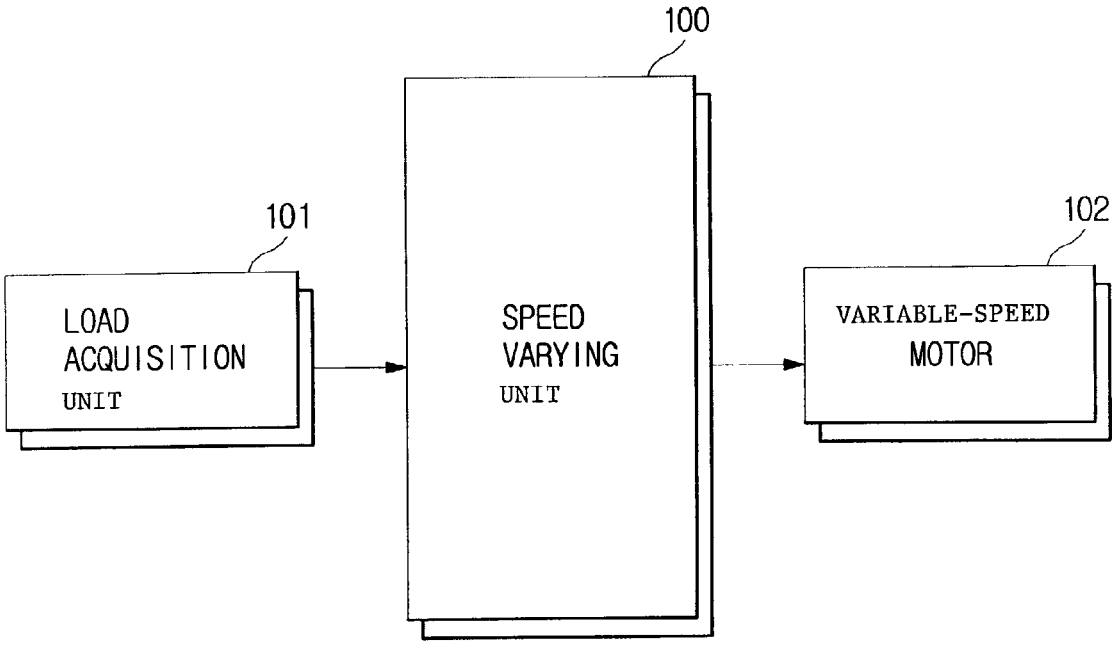
FIG. 2 is a control block diagram illustrating a method of varying a wobbling speed of a washboard according to a load of laundry in accordance with the present invention.

FIG. 2 shows a control block diagram illustrating a method of varying a wobbling speed of the washboard 60 according to a load of the laundry in accordance with the present invention.

Referring to FIG. 2, a wobbling washing machine of the present invention comprises a load acquisition unit 101, a variable-speed motor 102, and a speed varying unit 100. The load acquisition unit 101 acquires load information including an amount or weight of the laundry. The variable-speed motor 102 rotates to cause the washboard 60 to wobble. The speed varying unit 100 varies a wobbling speed of the washboard 60 by varying a rotating speed of the variable-speed motor 102 according to the load information acquired by the load acquisition unit 101.

Where an amount of the laundry is input, for example, from a user, instruction keys on an operation panel of the washing machine are used as the load acquisition unit 101. Where information is not input from the user, a weight sensor which senses a weight of the laundry, or a unit which estimates a weight of the laundry according to a time taken for a motor to reach a predetermined rotating speed, after rotating for a predetermined period of time, may be used as the load acquisition unit 101. The unit which estimates the weight of the laundry may use a speed sensor which measures the rotating speed of the motor, so as to measure the time taken for the motor to reach the predetermined rotating speed.

Such a speed varying unit 100 sets various rotating speeds of the variable-speed motor 102 corresponding to loads of laundry so as to set the wobbling speed of the washboard 60 to correspond to a respective load of laundry. Therefore, the speed varying unit 100 varies the rotating speed of the motor 102 to correspond to the load of the laundry, acquired by the load acquisition unit 101. At this time, where the load of the laundry is small, the speed varying unit 100 sets the rotating speed of the variable-speed motor 102 to be less than that of the motor 102 in a normal condition so as to set the wobbling speed of the washboard 60 to be less than that of a preset wobbling speed of the washboard 60 in a normal condition. On the other hand, where the load of laundry is large, the speed varying unit 100 sets the rotating speed of the variable-speed motor 102 to be greater than that of the motor 102 in a normal condition so as to set the wobbling speed of the washboard 60 to be greater than a preset wobbling speed of the washboard 60 in a normal condition.

Figure 3:
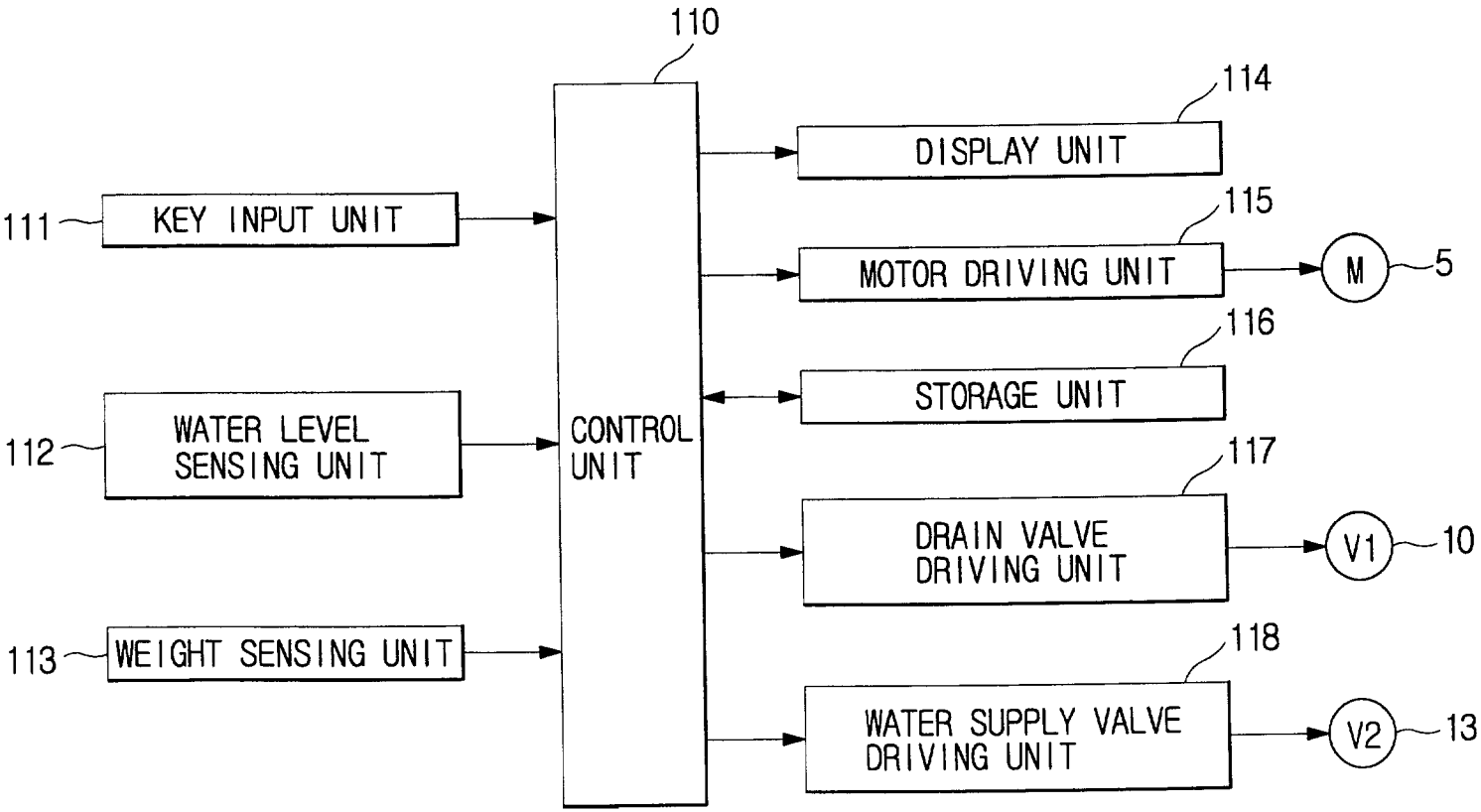
FIG. 3 is a control block diagram of the wobbling washing machine shown in FIG. 1.

FIG. 3 shows a control block diagram of a wobbling washing machine according to the present invention.

Referring to FIG. 3, the wobbling washing machine comprises a control unit 110 which controls entire washing operations of the washing machine using a wobbling device. An input terminal of the control unit 110 is electrically connected to a key input unit 111 which allows a user to input various pieces of washing information including a washing course, a water level sensing unit 112 which senses a level of wash water supplied to the washing tub 2, and a weight sensing unit 113 which senses a weight of laundry.

An output terminal of the control unit 110 is connected to a display unit 114, a motor driving unit 115, a storage unit 116, a drain valve driving unit 117, and a water supply valve driving unit 118. The display unit 114 displays operating states of the washing machine. The motor driving unit 115 drives the variable-speed motor 5 which rotates to cause the washboard 60 to wobble in washing and rinsing operations. The storage unit 116 stores data including rotating speeds of the motor 5, washing water levels, and washing times which correspond to several weights of laundry so as to cause the washboard 60 to wobble at different speeds according to the weights of the laundry. The drain valve driving unit 117 drives the drain valve 10, and the water supply valve driving unit 118 drives the water supply valve 13.

Figure 4:
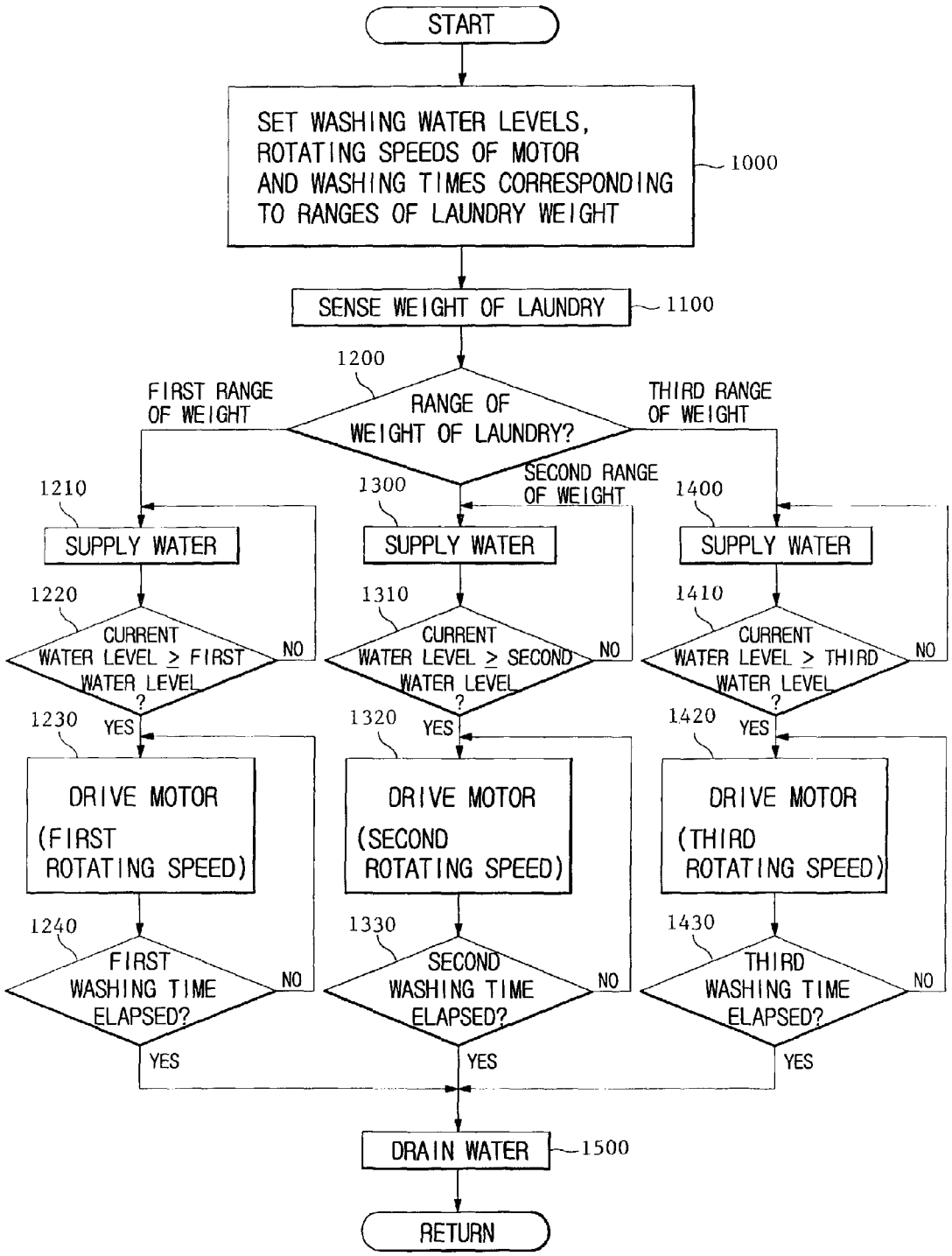
FIG. 4 is a control flowchart illustrating a method of varying a wobbling speed of a washboard according to a range of weight of laundry in accordance with the present invention.

FIG. 4 shows a control flowchart of a method of varying a wobbling speed of the washboard 60 according to a range of weight of laundry in accordance with the present invention.

Referring to FIG. 4, washing water levels, rotating speeds of the motor and washing times corresponding to ranges of weight of laundry are empirically determined and preset, as indicated in Table 1, in operation 1000.

TABLE 1

| Range of weight of laundry | Washing water level | Rotating speed of motor | Washing time |
|---|---|---|---|
| First range of weight | First water level | First rotating speed | First washing time |
| Second range of weight | Second water level | Second rotating speed | Second washing time |
| Third range of weight | Third water level | Third rotating speed | Third washing time |

Where a user puts laundry and detergent in the spin-drying tub 3 and inputs a washing course using the key input unit 101, the control unit 110 senses a weight of the laundry through the weight sensing unit 113 in operation 1100. In this case, the control unit 110 detects the weight of the laundry by reading an output signal of a weight sensor (not shown) which senses the weight of the laundry. Alternatively, without using the weight sensor, after the wobbling device 20 is switched to the leveling position and the spin-drying tub 3 is then rotated, a time taken for the driving speed of the motor 5 to reach a preset speed is measured using a motor speed sensor (not shown), and the weight of the laundry can be detected on the basis of the measured time.

Where the weight of laundry is detected, the control unit 110 determines a range of the sensed laundry weight in operation 1200.

Where it is determined that the weight of the laundry is within a preset first range of weight in the operation 1200, the control unit 110 opens the water supply valve 13 through the water supply valve driving unit 118 so as to supply wash water to the washing tub 2 in operation 1210.

Where the wash water is supplied, the control unit 110 compares a current water level sensed by the water level sensing unit 112 with a first water level falling within the first range of weight set in the operation 1000, and determines whether the current water level is equal to or greater than the first water level according to the compared result, in operation 1220.

Where it is determined that the current water level is equal to or greater than the first water level in the operation 1220, the control unit 110 stops the supply of water by closing the water supply valve 13 through the water supply valve driving unit 118, switches the wobbling device 20 to the wobbling position, and drives the motor 5 through the motor driving unit 115 to allow the motor 5 to rotate at a first rotating speed falling within the first range of weight set in the operation 1000, in operation 1230. Accordingly, the washboard 60 wobbles upwardly and downwardly while being inclined at a predetermined angle, thus enabling the laundry to be washed by applying impacts to the laundry.

Where the motor 5 is driven, the control unit 110 counts time for which the motor 5 is actually driven, compares the counted time with a predetermined first washing time falling within the first range of weight set in the operation 1000, and determines whether the counted time is equal to or greater than the first washing time according to the compared result, in operation 1240.

Where it is determined that the counted time is equal to or greater than the first washing time in the operation 1240, the control unit 110 opens the drain valve 10 through the drain valve driving unit 117 so as to drain the wash water in the washing tub 2, thus enabling soiled wash water to be drained to the outside through the drain hose 8 in operation 1500.

Hereinafter, a case where the weight of the laundry is within a second range of weight on the basis of the determined result in the operation 1200 is described in detail.

Where it is determined that the weight of the laundry is within the second range of weight, set to be greater than the first range of weight, in the operation 1200, the control unit 110 opens the water supply valve 13 through the water supply valve driving unit 118 so as to supply the wash water to the washing tub 2 in operation 1300.

Where the washing water is supplied, the control unit 110 compares a current water level sensed by the water level sensing unit 112 with a second water level, which falls within the second range of weight set in the operation 1000 and is set to be higher than the first water level, and determines whether the current water level is equal to or greater than the second water level according to the compared result, in operation 1310.

Where it is determined that the current water level is equal to or greater than the second water level in the operation 1310, the control unit 110 stops the supply of water by closing the water supply valve 13 through the water supply valve driving unit 118, switches the wobbling device 20 to the wobbling position, and drives the motor 5 through the motor driving unit 115 to allow the motor 5 to rotate at a second rotating speed, which falls within the second range of weight and is set to be higher than the first rotating speed in the operation 1000, in operation 1320. Accordingly, the washboard 60 wobbles upwardly and downwardly while being inclined at a predetermined angle, thus enabling the laundry to be washed by applying impacts to the laundry.

Where the motor 5 is driven, the control unit 110 counts time for which the motor 5 is actually driven, compares the counted time with a predetermined second washing time, which falls within the second range of weight set in the operation 1000 and is set to be longer than the first washing time, and determines whether the counted time is equal to or greater than the second washing time according to the compared result, in operation 1330.

Where it is determined that the counted time is equal to or greater than the second washing time in the operation 1330, the control unit 110 opens the drain valve 10 through the drain valve driving unit 117 so as to drain the washing water in the washing tub 2, thus enabling soiled wash water to be drained to the outside through the drain hose 8 in operation 1500.

Hereinafter, a case where the weight of the laundry is within a third range of weight set to be greater than the second range of weight, on the basis of the determined result in the operation 1200, is described in detail.

Where it is determined that the weight of the laundry is within the third range of weight, set to be greater than the second range of weight, in the operation 1200, the control unit 110 opens the water supply valve 13 through the water supply valve driving unit 118 so as to supply wash water to the washing tub 2 in operation 1400.

Where the wash water is supplied, the control unit 110 compares a current water level sensed by the water level sensing unit 112 with a third water level, which falls within the third range of weight set in the operation 1000 and is set to be higher than the second water level, and determines whether the current water level is equal to or greater than the third water level according to the compared result, in operation 1410.

Where it is determined that the current water level is equal to or greater than the third water level in the operation 1410, the control unit 110 stops the supply of water by closing the water supply valve 13 through the water supply valve driving unit 118, switches the wobbling device 20 to the wobbling position, and drives the motor 5 through the motor driving unit 115 to allow the motor 5 to rotate at a third rotating speed falling within the third range of weight set in the operation 1000, in operation 1420. Accordingly, the washboard 60 wobbles upwardly and downwardly while being inclined at a predetermined angle, thus enabling the laundry to be washed by applying impacts to the laundry.

Where the motor 5 is driven, the control unit 110 counts time for which the motor 5 is actually driven, compares the counted time with a predetermined third washing time, which falls within the third range of weight set in the operation 1000 and is set to be longer than the second washing time, and determines whether the counted time is equal to or greater than the third washing time according to the compared result, in operation 1430.

Where it is determined that the counted time is equal to or greater than the third washing time in the operation 1430, the control unit 110 opens the drain valve 10 through the drain valve driving unit 117 so as to drain the wash water in the washing tub 2, thus enabling soiled wash water to be drained to the outside through the drain hose 8 in operation 1500.

Figure 5:
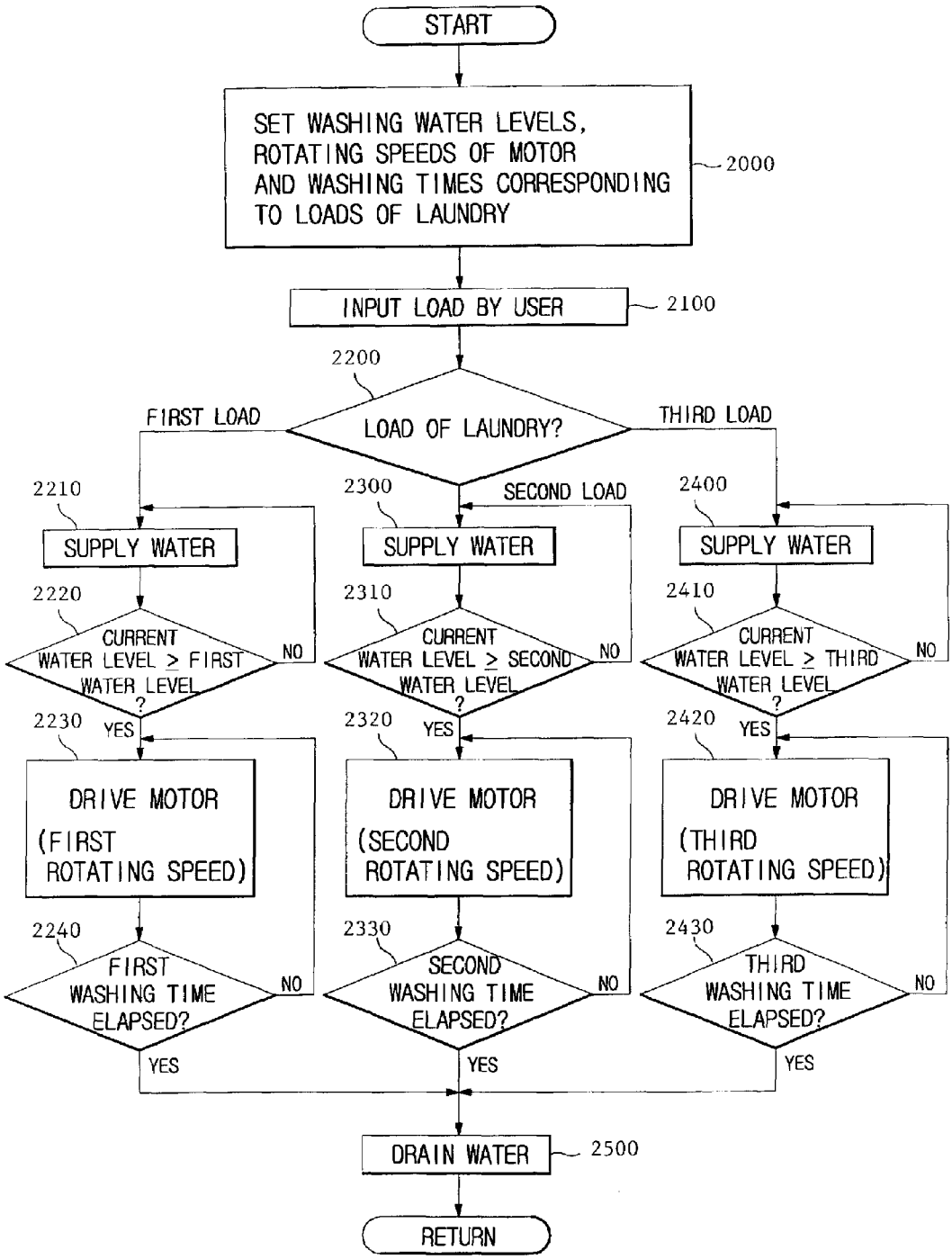
FIG. 5 is a control flowchart illustrating a method of varying a wobbling speed of a washboard according to a load of laundry, input by a user, in accordance with the present invention.

FIG. 5 shows a control flowchart of a method of varying a wobbling speed of a washboard according to a load of laundry, input by a user, in accordance with the present invention.

Referring to FIG. 5, washing water levels, rotating speeds of the motor and washing times corresponding to loads of laundry are empirically determined and preset, as indicated in Table 2, in operation 2000.

The user may place the laundry and detergent in the spin-drying tub 3 and input a washing course using the key input unit 101 in operation 2100.

TABLE 2

| Load of laundry | Washing water level | Rotating speed of motor | Washing time |
|---|---|---|---|
| First load | First water level | First rotating speed | First washing time |
| Second load | Second water level | Second rotating speed | Second washing time |
| Third load | Third water level | Third rotating speed | Third washing time |

Where the load of the laundry is input, the control unit 110 determines which one of the preset loads corresponds to the input load of the laundry in operation 2200.

Where it is determined that the load of the laundry is a preset first load in the operation 2200, the control unit 110 opens the water supply valve 13 through the water supply valve driving unit 118 so as to supply wash water to the washing tub 2 in operation 2210.

Where the wash water is supplied, the control unit 110 compares a current water level sensed by the water level sensing unit 112 with a predetermined first water level corresponding to the first load set in the operation 2000, and determines whether the current water level is equal to or greater than the first water level according to the compared result, in operation 2220.

Where it is determined that the current water level is equal to or greater than the first water level in the operation 2220, the control unit 110 stops the supply of water by closing the water supply valve 13 through the water supply valve driving unit 118, switches the wobbling device 20 to the wobbling position, and drives the motor 5 through the motor driving unit 115 to allow the motor 5 to rotate at a first rotating speed corresponding to the first load set in the operation 2000, in operation 2230. Accordingly, the washboard 60 wobbles upwardly and downwardly while being inclined at a predetermined angle, thus enabling the laundry to be washed by applying impacts to the laundry.

Where the motor 5 is driven, the control unit 110 counts time for which the motor 5 is actually driven, compares the counted time with a predetermined first washing time corresponding to the first load set in the operation 2000, and determines whether the counted time is equal to or greater than the first washing time according to the compared result, in operation 2240.

Where it is determined that the counted time is equal to or greater than the first washing time in the operation 2240, the control unit 110 opens the drain valve 10 through the drain valve driving unit 117 so as to drain the wash water in the washing tub 2, thus enabling soiled wash water to be drained to the outside through the drain hose 8 in operation 2500.

Hereinafter, a case where the load of the laundry is a preset second load on the basis of the determined result in the operation 2200 is described in detail.

Where it is determined that the load of the laundry is the second load, set to be greater than the first load, in the operation 2200, the control unit 110 opens the water supply valve 13 through the water supply valve driving unit 118 to supply wash water to the washing tub 2 in operation 2300.

Where the wash water is supplied, the control unit 110 compares a current water level sensed by the water level sensing unit 112 with a second water level, which corresponds to the second load set in the operation 2000 and is set to be higher than the first water level, and determines whether the current water level is equal to or greater than the second water level according to the compared result, in operation 2310.

Where it is determined that the current water level is equal to or greater than the second water level in the operation 2310, the control unit 110 stops the supply of water by closing the water supply valve 13 through the water supply valve driving unit 118, switches the wobbling device 20 to the wobbling position, and drives the motor 5 through the motor driving unit 115 to allow the motor 5 to rotate at a second rotating speed, which corresponds to the second load set in the operation 2000 and is set to be higher than the first rotating speed, in operation 2320. Accordingly, the washboard 60 wobbles upwardly and downwardly while being inclined at a predetermined angle, thus enabling the laundry to be washed by applying impacts to the laundry.

Where the motor 5 is driven, the control unit 110 counts time for which the motor 5 is actually driven, compares the counted time with a predetermined second washing time, which corresponds to the second load set in the operation 2000 and is set to be longer than the first washing time, and determines whether the counted time is equal to or greater than the second washing time according to the compared result, in operation 2330.

Where it is determined that the counted time is equal to or greater than the second washing time in the operation 2330, the control unit 110 opens the drain valve 10 through the drain valve driving unit 117 so as to drain the wash water in the washing tub 2, thus enabling soiled wash water to be drained to the outside through the drain hose 8 in operation 2500.

Hereinafter, a case where the load of the laundry is a third load set to be greater than the second load, on the basis of the determined result in the operation 2200, is described in detail.

Where it is determined that the load of the laundry is the third load, set to be greater than the second load, in the operation 2200, the control unit 110 opens the water supply valve 13 through the water supply valve driving unit 118 to supply wash water to the washing tub 2 in operation 2400.

Where the wash water is supplied, the control unit 110 compares a current water level sensed by the water level sensing unit 112 with a third water level, which corresponds to the third load set in the operation 2000 and is set to be higher than the second water level, and determines whether the current water level is equal to or greater than the third water level according to the compared result, in operation 2410.

Where it is determined that the current water level is equal to or greater than the third water level in the operation 2410, the control unit 110 stops the supply of water by closing the water supply valve 13 through the water supply valve driving unit 118, switches the wobbling device 20 to the wobbling position, and drives the motor 5 through the motor driving unit 115 to allow the motor 5 to rotate at a third rotating speed corresponding to the third load set in the operation 2000, in operation 2420. Accordingly, the washboard 60 wobbles upwardly and downwardly while being inclined at a predetermined angle, thus enabling the laundry to be washed by applying impacts to the laundry.

Where the motor 5 is driven, the control unit 110 counts time for which the motor 5 is actually driven, compares the counted time with a third washing time, which corresponds to the third load set in the operation 2000 and is set to be longer than the second washing time, and determines whether the counted time is equal to or greater than the third washing time according to the compared result, in operation 2430.

Where it is determined that the counted time is equal to or greater than the third washing time in the operation 2430, the control unit 110 opens the drain valve 10 through the drain valve driving unit 117 so as to drain the wash water in the washing tub 2, thus enabling soiled wash water to be drained to the outside through the drain hose 8 in operation 2500.

As described above, the present invention provides a wobbling washing machine and a method of controlling the same, which varies a rotating speed of a motor according to a load of laundry so as to decrease a wobbling speed of a washboard in response to the load of the laundry being small, and increase the wobbling speed in response to the load of the laundry being large, thus enabling the washing machine to suitably perform a washing operation according to the load of the laundry.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A wobbling washing machine, comprising:
- a housing which defines an outer appearance of the wobbling washing machine;
- a tub to receive laundry;
- a washboard which wobbles to wash the laundry;
- a motor having a preset speed corresponding to a weight load of the laundry which rotates to cause the washboard to wobble;
- a motor speed sensor which measures a time for the motor to reach the preset speed;
- a control unit which controls a wobbling speed of the washboard, comprising:
  - a water level sensing unit which senses a level of wash water supplied to the wobbling washing machine;
  - a weight sensing unit which senses the weight load of the laundry; and
  - a speed varying unit which varies the wobbling speed of the washboard to correspond to the weight load of the laundry,
- wherein the control unit detects the weight load of the laundry based on the time measured by the motor speed sensor.

2. The wobbling washing machine according to claim 1, wherein the speed varying unit increases the wobbling speed of the washboard as the load of laundry increases.

3. The wobbling washing machine according to claim 2, wherein the speed varying unit varies the wobbling speed of the washboard by varying a rotating speed of the motor.

4. The wobbling washing machine according to claim 1, further comprising:
- a load acquisition unit which receives load information of the laundry corresponding to the weight load of the laundry.

5. The wobbling washing machine according to claim 1, wherein the control unit, further comprises:
- an input terminal, and
- a key input unit to input a washing course,
- wherein the key input, water level sensing and weight sensing units are electrically connected to the input terminal.

6. The wobbling washing machine according to claim 5, further comprising:
- a display unit which displays operating states of the wobbling washing machine,
- wherein the control unit, further comprises:
  - an output terminal connected to the display unit,
  - a motor driving unit which drives the motor,
  - a storage unit which stores data including rotating speeds of the motor, and
  - a water supply valve driving unit which controls inflow of the wash water to the wobbling washing machine.

7. A wobbling washing machine, comprising:
- a housing which defines an outer appearance of the wobbling washing machine;
- a tub to receive laundry;
- a washboard which wobbles to wash the laundry;
- a motor having a preset speed corresponding to a weight load of the laundry which rotates to cause the washboard to wobble;
- a motor speed sensor which measures a time for the motor to reach the preset speed;
- a weight sensing unit which senses the weight load of the laundry;
- a speed varying unit which varies a rotating speed of the motor in response to an output signal of the weight sensing unit; and
- a water level sensing unit which senses a level of wash water supplied to the wobbling washing machines,
- wherein the speed varying unit is a control unit which outputs a control signal to vary the rotating speed of the motor, to correspond to the output signal of the weight sensing unit, to the motor and detects the weight load of the laundry based on the time measured by the motor speed sensor.

8. The wobbling washing machine according to claim 7, wherein the speed varying unit varies the rotating speed of the motor according to the output signal output from the weight sensing unit.

9. The wobbling washing machine, according to claim 7, wherein the control unit recognizes the weight load of the laundry according to the output signal of the weight sensing unit, and outputs the control signal so as to allow the motor to have the rotating speed corresponding to the load of the laundry.

10. The wobbling washing machine according to claim 7, wherein the weight sensing unit is one of a weight sensor which senses the weight load of the laundry.

11. A wobbling washing machine, comprising:
- a housing which defines an outer appearance of the wobbling washing machine;
- a tub to receive laundry;
- a washboard which wobbles to wash the laundry;
- a motor having a preset speed corresponding to a weight load of the laundry which rotates to cause the washboard to wobble;
- a motor speed sensor which measures a time for the motor to reach the preset speed;

a weight sensing unit which senses the weight load of the laundry;

a speed varying unit which varies a rotating speed of the motor in response to an output signal of the weight sensing unit;

a control unit which controls a washing operation of the wobbling washing machine;

a key input unit which receives weight load information of the laundry corresponding to the weight of the laundry;

a water level sensing unit which senses a level of wash water supplied to the wobbling washing machine;

a display unit which displays an operating state of the wobbling washing machine;

a motor driving unit which drives the motor;

a storage unit which stores data including rotating speeds of the motor;

a drain valve driving unit which controls outputting of the wash water to the outside of the wobbling washing machine; and a water supply driving unit which controls inflow of the wash water to the wobbling washing machine, wherein:

the key input, water level sensing and weight sensing units are electrically connected to an input terminal of the control unit, the display, motor driving, storage, drain valve driving, and water supply driving units are electrically connected to an output terminal of the control unit, and the control unit detects the weight load of the laundry based on the time measured by the motor speed sensor.

* * * * *

UNITED STATES PATENT AND TRADEMARK OFFICE

CERTIFICATE OF CORRECTION

PATENT NO. : 7,228,718 B2
APPLICATION NO. : 10/310831
DATED : June 12, 2007
INVENTOR(S) : Hyun-Sook Kim It is certified that error appears in the above-identified patent and that said Letters Patent is hereby corrected as shown below:

Column 10, Line 38, change “machines,” to --machine,--.

Signed and Sealed this

Fourth Day of December, 2007

JON W. DUDAS
*Director of the United States Patent and Trademark Office*